US009334758B2

(12) United States Patent
Archambeault et al.

(10) Patent No.: US 9,334,758 B2
(45) Date of Patent: May 10, 2016

(54) STEAM TURBINE MOISTURE REMOVAL SYSTEM

(71) Applicant: SIEMENS ENERGY, INC., Orlando, FL (US)

(72) Inventors: David J. Archambeault, Princeton, MA (US); Donald R. Leger, Westminster, MA (US)

(73) Assignee: Siemens Energy, Inc., Orlando, FL (US)

( * ) Notice: Subject to any disclaimer, the term of this patent is extended or adjusted under 35 U.S.C. 154(b) by 131 days.

(21) Appl. No.: 14/284,446

(22) Filed: May 22, 2014

(65) Prior Publication Data

US 2014/0360190 A1 Dec. 11, 2014

Related U.S. Application Data

(60) Provisional application No. 61/831,186, filed on Jun. 5, 2013.

(51) Int. Cl.
*F01D 25/32* (2006.01)

(52) U.S. Cl.
CPC ..... *F01D 25/32* (2013.01)

(58) Field of Classification Search
CPC ..... F01D 25/32
See application file for complete search history.

(56) References Cited

U.S. PATENT DOCUMENTS

| | | | | |
|---|---|---|---|---|
| 4,355,515 | A * | 10/1982 | Cohen | F22B 37/28 60/646 |
| 4,434,620 | A * | 3/1984 | Ishimaru | F22D 11/006 60/657 |
| 5,079,922 | A | 1/1992 | Viscovich | |
| 5,868,925 | A | 2/1999 | Turchetti | |
| 8,544,282 | B2 | 10/2013 | Wyer | |
| 2013/0180703 | A1 * | 7/2013 | Colby | E21B 41/00 166/75.13 |

* cited by examiner

*Primary Examiner* — Audrey K Bradley

(57) ABSTRACT

A drain system (10) for connection to a steam turbine (14). The drain system comprises a main drain line (20) providing a main flow path and a bypass drain line (28) providing a bypass flow path parallel to the main flow path. The main drain line and the bypass drain line are external to the steam turbine. The drain system further comprises a drain orifice assembly (22) within the main drain line, with the drain orifice assembly accessible during operation of the steam turbine. The main drain line and the bypass drain line are connected to a drain path (24) for carrying condensate and contaminants from the steam turbine.

18 Claims, 1 Drawing Sheet

STEAM TURBINE MOISTURE REMOVAL SYSTEM

This application claims benefit of the 5 Jun. 2013 filing date of U.S. provisional patent application No. 61/831,186, which is incorporated by reference herein.

FIELD OF THE INVENTION

The invention relates generally to steam turbines and specifically to drain systems for geothermal steam turbines.

BACKGROUND OF THE INVENTION

Steam turbines convert the kinetic energy present in a steam flow to rotational energy of a turbine shaft. The steam flow impinges turbine blades connected to the turbine shaft thus causing the shaft to rotate. The turbine shaft is connected to a generator shaft to transfer the rotational energy to the generator for generating electricity according to well-known generator principles.

Typically a steam turbine comprises several turbine stages each optimized for specific steam conditions. As the steam flow passes serially through the turbine stages it gives up kinetic energy to rotate the turbine shaft.

In conventional power plants the steam flow is produced by burning coal or natural gas and using the resulting heat to boil water and create the steam flow. In nuclear power plants fission energy is captured to convert the water to a steam flow.

Geothermal energy is generated and stored in the Earth. The thermal energy (from molten rock and radioactive decay of minerals within the Earth's crust, for example) heats underground water that is trapped within pockets. The water may also rise to the surface through cracks and between geological plates. Wells are drilled into the pockets and the water/steam mixture, or sometimes pure steam, then flows through pipes to the surface. Upon escaping from the high underground pressure, the heated water turns to a mixture of steam and hot water (i.e., a mixed phase fluid). The mixed phase fluid passes through a cyclone separator where the liquid is separated from the steam. The steam is captured and piped to a geothermal turbine. The liquid (also referred to as brine) is re-injected into the earth where it will be reheated. At a few geographic locations, superheated steam is ejected from the earth's crust thus eliminating the need for a separator stage.

The steam strikes turbine blades causing the geothermal turbine shaft to turn. Like the steam turbines described above, the shaft of the geothermal steam turbine is connected to a generator shaft; rotation of the generator shaft generates electricity according to known generator principles.

To further improve operation and efficiency of the geothermal turbine, water and impurities/contaminants (referred to herein as contaminants) are also partially removed from the steam flow prior to entering the turbine. Removing water from the steam flow, i.e., "drying" the steam flow, permits the turbine to operate at a higher efficiency and reliability.

The steam flow rate through the stages of a geothermal turbine (and therefore the generated electricity) varies based on: stage position in the serial string of stages, percent of moisture at the turbine inlet, the number of turbine stages, the exhaust pressure etc.

The advantages of geothermal energy generation include the clean and safe generation process and its use for supplying continuous and reliable base load power for a utility system. Electricity generated from geothermal sources conserves our fossil fuels and contributes to a diverse base load generation along with reduced greenhouse gas emissions.

The temperature of the underground steam may be close to the steam saturation point, and therefore the steam is in near-equilibrium with heated water. If the saturated steam is reduced in temperature or pressure (e.g., as the steam flows through the turbine and relinquishes its kinetic energy to create rotational energy) the steam condenses to produce water droplets.

These condensation droplets can damage blades of the steam turbine. Ideally, the droplets should be removed from the turbine at each turbine stage to prevent impingement on the rotating blades (and resulting corrosion and erosion) and to improve overall performance and efficiency.

Additionally, since the steam originates far below the surface of the earth and flows through layers of rock to reach the earth's surface, it contains various silicates and other contaminants that can both physically and chemically damage the turbine blades, including corrosion-induced fatigue that can lead to premature failure of turbine components, especially the turbine rotor and blades.

To remove the contaminants that have precipitated or coated the turbine internal components, geothermal turbines are periodically water-washed. Water washing involves directing a water stream into the turbine during operation. The turbine stationary nozzles and rotating blades are cleaned by the impingement of the water stream. The water then flows to and collects at the bottom of the turbine casing (enclosure) between each stage.

The condensate (i.e., condensed water) and the washing water collect at the bottom of the turbine casing are removed from the turbine casing through drain pipes.

Prior art geothermal turbines use a water drain system comprising a drain component (e.g., a pipe) at a low point within the casing where the water collects. However the contaminants within the steam/water flow may plug the pipe, thereby preventing effective water removal from the turbine.

With a plugged drain the water remains within the turbine causing erosion and corrosion of its components, especially the turbine blades. Since the pipe is internally fixed to the turbine casing, to access a plugged drain the turbine must be shut down and the casing upper half, the rotor and the turbine diaphragms removed. Only then can one gain access to the plug pipe.

Shutting down the geothermal turbine also results in lost revenue for the owner/operator and material and labor costs expended to diagnosis and conduct the repair.

Also in the prior art it is common for every stage to have the same diameter pipe exiting the turbine casing. This configuration is sub-optimal for both performance and reliability.

In certain prior art turbines each stage is optimized based on steam pressure, temperature, moisture content, differential pressure, the amount of water expected to flow through the pipe, etc. Each stage therefore comprises an appropriately sized (i.e., diameter) drain pipe. Typically each successive drain pipe (following the direction of steam flow and therefore toward the lower pressure stages of the turbine) has a larger diameter. The drain pipes within the water drain system may be sized for each stage in the design phase and then optimized during startup/operation.

But sizing each pipe diameter during the turbine design phase is problematic. To maintain the optimum moisture removal from the turbine casing, the diameter should be as small as permitted by the operating parameters of the turbine stage. In contrast, to avoid pipe clogging by contaminants, the diameter should be as large as possible. Clearly these two interests are in opposition.

Further, the diameter of the pipe may be sized based on an amount of water that is desired to be removed from the incoming steam flow during operation. But components designed to remove this water may not be able to achieve that desired objective. As a result the steam flow impinging the blades may contain more water than expected and desired. This excess water is carried from the turbine by the drain system, which now may be undersized given the additional water volume.

BRIEF DESCRIPTION OF THE DRAWINGS

The invention is explained in the following description in view of the drawings that show.

DETAILED DESCRIPTION OF THE INVENTION

Figure 1:
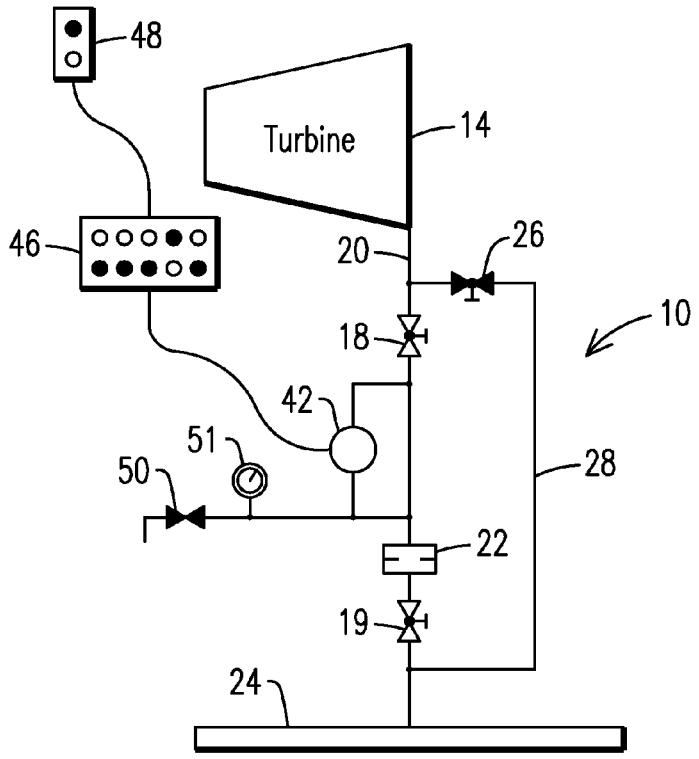
FIG. 1 is a schematic drawing of a moisture removal system of the present invention.

Unlike the drain systems of the prior art, the drain system of the present invention provides an appropriately sized orifice drain plate within the main drain line. The plate and its associated components provide on-line in-situ monitoring and serviceability, allowing the owner/operator to clean and/or replace steam turbine drain orifice plates while the turbine remains on-line generating electricity. Thus the present invention provides effective moisture removal, reduces generator down-time, improves turbine reliability and performance, and reduces maintenance costs.

Each drain orifice plate (one for each turbine stage) can be removed and exchanged for a differently-sized orifice plate. The drain orifice plates are therefore a significant improvement over the simple drain pipes at the lowest point of the turbine casing of the prior art.

The orifice diameter for each stage can be optimized during turbine operation in conjunction with an indication of the operational status of the water level upstream of the orifice plate. The external piping configuration of the present invention permits removal of the drain orifice plate and replacement with a plate having a different diameter opening therein. As known to those skilled in the art, if the orifice plate opening diameter in any turbine stage is too large excess steam will escape through the orifice plate and turbine performance will be adversely impacted (due to reduced steam flow through downstream stages).

Since the amount of moisture collected at each stage is higher during start-up and water washing, the present invention also comprises an external bypass line (i.e., bypassing the main drain line and the drain orifice plate disposed therein) that allows any additional condensate flow to be drained from the turbine. The bypass line may also be opened to avoid the risk of orifice plugging during water washing since the objective of water washing is to remove contaminants (solids) that have precipitated on the turbine blades. When this additional solid material is discharged through the bypass line orifice plate plugging is minimized.

Annunciation of orifice plugging is also included in the present invention. This feature provides an indication of orifice plugging or a change in operating conditions that requires removal of additional moisture during operation by virtue of a level of water collecting ahead of the orifice that causes a water level switch to close.

The present invention provides not only a safe indication of a plugged condition but also an annunciation when the condition is cleared. In one embodiment a monitoring scheme causes a green light to illuminate indicating that the orifice line is operating properly. When the water level rises, the water level switch closes, extinguishing the green light and simultaneously illuminating a red light. Coincident with illumination of the red light, the monitoring system sends a signal to a control room indicating a problem with the turbine drain system.

FIG. 1 is a schematic diagram of a drain system 10 operative with and disposed outside of a casing of a turbine 14. In one embodiment the turbine 14 comprises a geothermal turbine of the type described above.

Preferably the turbine 14 comprises a plurality of pressure stages and each stage operates with an associated drain system, such as the drain system 10. Although only one drain system (associated with one stage of the turbine) is illustrated and described, those skilled in the art recognize that several such drain systems are configured in parallel and connected to the turbine with one drain system for each turbine stage.

During normal operation of the drain system 10, isolation valves 18 and 19 within a condensate main drain line 20 are open. Condensed water (condensate) and any contaminants it carries flow through the main drain line 20, open isolation valves 18 and 19, and a drain orifice assembly 22 (comprising a drain orifice plate internal thereto) to a drain header 24.

In lieu of the drain header, the water can enter a condenser or any pipe or component that carries the water away from the drain system 10. The condenser operates under a vacuum and collects the condensate and contaminants. Typically all of the drain stages are connected to the condenser, which pulls the condensate and contaminants from each stage. Once collected, the condensate (and its contaminants) must be processed like the turbine exhaust condensate.

A bypass valve 26 is normally closed to prevent excessive steam discharge from condensate drain line 20.

As known by those skilled in the art, the drain line 20 must be at a lower pressure than the turbine stage for the condensate to flow in the correct direction.

Although the bypass valve 26 is illustrated as a manual valve, in other embodiments the bypass valve comprises a motor-driven or air-actuated valve when some level of automation is desired. The latter valves can then be integrated with a plant control system that controls the bypass valve to an open state as needed, for example during start-up or water washing.

Figure 2:
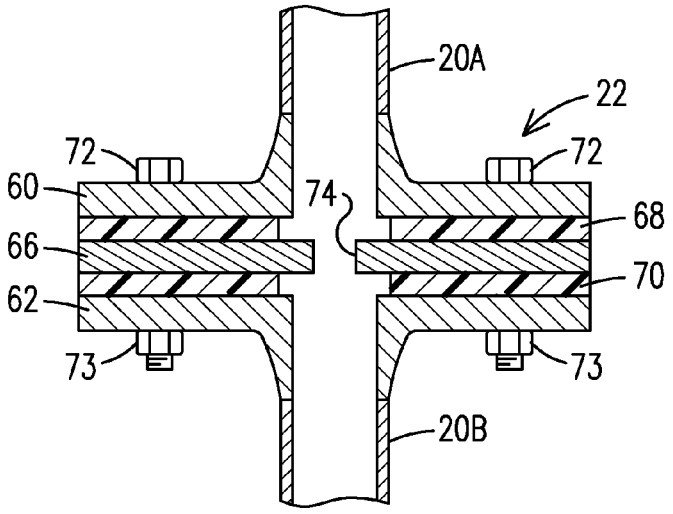
FIG. 2 is a detailed cross-sectional illustration of a drain orifice assembly of FIG.

FIG. 2 is a detailed cross-sectional view of the various components associated with the drain orifice assembly 22 installed between an upper 20A and a lower 20B segment of the main drain line 20. Specifically, an upper flange 60 is attached to the upper main drain line segment 20A and a lower flange 62 is attached to the lower main drain line segment 20B. A drain orifice plate 66 is disposed between an upper gasket 68 and a lower gasket 70; the gaskets are in turn sandwiched between the upper and lower flanges 60 and 62 as shown. Bolts 72 and mating nuts 73 hold the various components of the drain orifice assembly 22 together.

Figure 3:
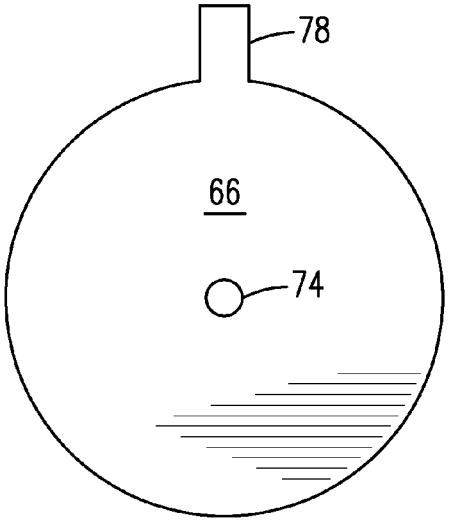
FIG. 3 is an illustration of an orifice plate for use with the drain orifice assembly of FIG. 2.

Generally, an orifice diameter is about one-third of an inner diameter of the main drain line 20. See FIG. 3. It is generally noted that this one-third value is an approximation and applies to only certain embodiments. The intent is for the diameter of the orifice to be substantially smaller than an inner diameter of the main drain line 20 exiting the turbine casing. This ensures that any buildup of deposits and/or blockage occurs external to the turbine at the orifice plate 66 where it remains in a serviceable and accessible location to plant maintenance staff while the turbine 14 is on-line.

In one embodiment a material of the drain orifice plate 66 comprises stainless steel sheet metal with an orifice 74 defined therein. See FIG. 3. A tab 78, extending from the plate 66, carries a marking indicating the size of the orifice. The tab 78 also aids disassembly of the drain orifice assembly 22.

The orifice 74 is sized for each turbine stage. A steam turbine comprises a plurality of stages with the steam pressure falling as the steam passes serially through each stage. Thus the opening within each stage-based drain orifice plate 66 is sized based on the steam pressure, expected condensate flow volume, and other operational characteristics of that turbine stage.

Returning to FIG. 1, the present invention comprises a monitoring device 42 (e.g., a float switch) for the drain system 10 of each stage. The monitoring device 42 senses when condensate has backed-up within the main drain line 20 and has exceeded a predetermined condensate threshold level. The condensate backup may be due to clogging of the drain orifice plate by contaminants drained from within the turbine 14 or may be an indication that the opening in the drain orifice plate is not sized for the current operating condition.

Responsive thereto, the monitoring device 42 issues a fault signal indicating a water back-up. An annunciator provides one or both of a local fault indication (for example at an annunciator 46 disposed proximate the turbine 14) and a remote fault indication (for example at an annunciator 48 within a control room) of the fault signal. The fault indication may be aural or visual at one or both of the annunciators 46 and 48.

In lieu of using a float switch as described above, the monitoring device may comprises a pressure and/or temperature sensor (or any other sensor or apparatus that can sense improper operation of the drain components) to detect an increased pressure due to a clogged or an improperly sized drain orifice plate 66.

Responsive to a fault indication from the annunciators 46 or 48 or another indication that the drain system 10 is not functioning properly, a turbine operator can isolate the effected drain system 10 and in particular the main drain line 20 thereof. This is done by closing the isolation valves 18 and 19 and opening the bypass valve 26.

These valves can be opened (and closed) automatically or manually. For example, the isolation valves 18 and 19 can be closed and the bypass valve 26 opened in conjunction with the issuance of a fault signal by the monitoring device 42.

This configuration of the valves 18, 19 and 26 opens the bypass route through the by-pass loop 28 and closes the main drain line 20, thus isolating the drain orifice assembly 22 from the condensate flow.

Once the condensate bypass line has been opened and the isolation valves closed, a safety depressurization device, referred to as a single block and bleed valve 50, is slowly opened to depressurize the turbine stage and in particular to release any pressure entrained between the isolation valves 18 and 19. In some cases, where certain safety codes apply, it may be necessary to use a double block and bleed arrangement for additional safety/redundancy. This choice is governed by the specific utility safety standards.

Another embodiment comprises a pressure gage 51 to provide the operator with a visual indication of the presence of steam pressure in the main drain line 20.

Once depressurized, a plant technician can remove the drain orifice plate 66 from the drain orifice assembly 22 to either clean or replace the drain orifice plate. At this time other components within the drain system 10 can be replaced or cleaned as required.

After the orifice plate 66 has been reinstalled, the bleed valve 50 is closed, the isolation valves 18 and 19 opened and finally the bypass valve 26 closed to return the drain system 10 to its normal operating configuration.

The invention also offers certain safety features. When a fault indication is issued (presumably because the drain line 20 is clogged or conditions have changed resulting in excessive water removal) for a prior art drain system, it was necessary for a technician to close the isolation valves 18 and 19 and bleed the turbine stage by opening the bleed valve 50. The latter operation could be hazardous due to the release of hot/pressurized steam entrained between the isolation valves 18 and 19. With the present invention the bypass valve 26 is opened before opening the bleed valve, thereby relieving pressure in the drain system.

In any situation when the drain orifice plate 66 is clogged it is not necessary to immediately clean or replace the drain orifice plate as it was according to the prior art. Instead, the valves of the drain system 10 are then reconfigured to permit the water to flow through the bypass loop 28. Generally, this technique is considered a temporary solution as the turbine stage will not operate as efficiently when the bypass line 28 is employed to drain condensate and contaminants from the turbine.

The alarm system of the invention can also be used to fine tune drain system performance during turbine commissioning and start-up. If the optimum orifice size can be determined for each drain orifice plate, the drain system performance can be optimized and turbine performance improved via the reheat effect. As known by those skilled in the art, the reheat effect refers to a change in steam enthalpy when the amount of moisture within the steam is reduced. As the moisture percentage decreases, the enthalpy increases, which increases the available energy across each stage to be extracted from the steam flow by the rotating turbine blades. This principle applies to both reaction and impulse design geothermal steam turbines and is not specific to either.

An initial opening size is determined according to turbine design parameters and the size fine-tuned by incrementally drilling larger openings in the drain orifice plate or as necessary using a new plate with a smaller or larger hole size. If a fault indication is issued for a turbine stage, it may be an indication that the orifice diameter for that stage is too small (i.e., the water is not flowing through the orifice as quickly as designed). The orifice size is then incrementally enlarged. The orifice opening size may be increased in small increments (e.g., 1/16") until a fault indication is not issued.

As described, the invention is also useful for determining the appropriate diameter for the opening in the drain orifice plate for each generator stage. Advantageously, this resizing operation can be conducted while the turbine 14 is operating by passing the water through the bypass loop 28 as described above.

During water wash operations it may be desirable to permit the water to flow through the bypass loop 28 (which notably does not have an orifice plate) rather than through the drain line 20. The isolation valves 18 and 19 are closed to isolate the orificed drain component 22 and the bypass valve 26 is opened. Particulate matter draining during this operation flows only through the bypass loop 28. This technique avoids clogging the orificed drain component 22 during a water wash operation.

The present invention may be particularly beneficial for steam turbines that operate at low steam temperatures. As the steam temperature is lowered, the amount of moisture (condensate) in the steam increases. The present invention is useful for removing condensate from steam within a steam generator and thus is particularly useful for generators that operate at low steam temperatures. In particular, the invention is ideally suited for geothermal turbines since the typical steam inlet temperature is near the steam saturation point and therefore each turbine stage will benefit from the teachings of the present invention.

In an application where the inlet steam is superheated then by definition there is no moisture content within the steam flow.

While various embodiments of the present invention have been shown and described herein, it will be obvious that such embodiments are provided by way of example only. Numerous variations, changes and substitutions may be made without departing from the invention herein. Accordingly, it is intended that the invention be limited only by the spirit and scope of the appended claims.

The invention claimed is:

1. A drain system for connecting to a steam turbine, the drain system comprising:

a main drain line providing a main flow path external to the steam turbine;

a bypass drain line providing a bypass flow path parallel to the main flow path, the bypass flow path external to the steam turbine;

a drain orifice assembly within the main drain line, the drain orifice assembly accessible during operation of the steam turbine; and the main drain line and the bypass drain line configured for connection to a drain path for carrying condensate and contaminants from the steam turbine;

further comprising a monitoring device for monitoring a condition in the main drain line and for issuing a fault signal responsive to the condition in the main drain line.

2. The drain system of claim 1 wherein the fault signal is issued responsive to one or more of a condensate level, a condensate temperature, and a condensate pressure within the main drain line.

3. The drain system of claim 1 wherein the steam turbine comprises a geothermal steam turbine.

4. The drain system of claim 1 further comprising an annunciator responsive to the fault signal for providing an aural or visual alarm responsive thereto.

5. The drain system of claim 1 wherein the drain path comprises a drain header or a condenser.

6. The drain system of claim 1 wherein the monitoring device comprises a float switch and the float switch closes and issues the fault signal when a water level in the main drain line reaches a predetermined level.

7. The drain system of claim 6 wherein the fault signal is received by an annunciator located proximate the main drain line or located within a control room.

8. A drain system for connecting to a steam turbine, the drain system comprising:

a main drain line providing a main flow path external to the steam turbine;

a bypass drain line providing a bypass flow path parallel to the main flow path, the bypass flow path external to the steam turbine;

a drain orifice assembly within the main drain line, the drain orifice assembly accessible during operation of the steam turbine; and the main drain line and the bypass drain line configured for connection to a drain path for carrying condensate and contaminants from the steam turbine;

further comprising an isolation component for isolating the main drain line from the steam turbine and a bypass component for connecting the bypass drain line to the steam turbine.

9. The drain system of claim 8 wherein the isolation component comprises first and second isolation valves positioned in the main drain line and the bypass component comprises a bypass valve, the first, second and bypass valves configured such that closing of the first and second isolation valves and opening of the bypass valve closes the main drain line and permits condensate to flow through the bypass drain line.

10. The drain system of claim 8 wherein the drain orifice assembly comprises:

an upper flange for attaching to a first end of the main drain line;

a drain orifice plate defining an opening there through, the condensate passing through the opening;

a lower flange for attaching to a second end of the main drain line;

an upper gasket disposed between the upper flange and a first surface of the drain orifice plate; and a lower gasket disposed between the lower flange and a second surface of the drain orifice plate.

11. The drain system of claim 10 wherein the drain orifice assembly comprises an indicator indicating a diameter of the opening within the drain orifice plate.

12. The drain system of claim 10 wherein a size of the opening is selected to be responsive to one or more of turbine stage location relative to a steam inlet, steam pressure, temperature, steam moisture content, differential pressure and the amount of water to flow through the drain system.

13. A method associated with a steam turbine, comprising:

during a predetermined operational condition, opening a condensate bypass flow path and closing a condensate main flow path associated with a turbine stage;

while the steam turbine is operational, replacing a first drain orifice plate in the main flow path with a second drain orifice plate having an orifice diameter different from an orifice diameter of the first drain orifice plate; and opening the condensate main flow path and closing the condensate bypass flow path.

14. The method of claim 13 wherein the predetermined operational condition comprises at least one of: an annunciation that condensate is not draining through the first drain orifice plate at a desired rate; during water washing; during turbine start-up; and during a change in operating conditions requiring removal of additional moisture from the turbine.

15. The method of claim 13 wherein the steam turbine comprises a geothermal steam turbine.

16. A method for operating a steam turbine, comprising:

selecting a first drain orifice plate defining a first opening having a first diameter;

installing the first drain orifice plate in a condensate main drain line associated with a turbine stage;

operating the steam turbine;

responsive to an indication that water is not draining through the main drain line at a desired rate, opening a condensate bypass drain line and closing the condensate main drain line;

while the steam turbine is operating, replacing the first drain orifice plate with a second drain orifice plate defining a second opening having a second diameter different from the first diameter; and opening the condensate main drain line and closing the condensate bypass drain line.

17. The method of claim 16 wherein the indication comprises a fault signal input to an annunciator for providing an aural alarm or a visual alarm responsive thereto.

18. The method of claim 16 wherein the steam turbine comprises a geothermal steam turbine.

* * * * *